US007673679B2

(12) United States Patent
Harrison et al.

(10) Patent No.: US 7,673,679 B2
(45) Date of Patent: Mar. 9, 2010

(54) PROTECTIVE BARRIERS FOR SMALL DEVICES

(75) Inventors: Christopher Harrison, Stamford, CT (US); Oliver C. Mullins, Ridgefield, CT (US); Olivier Vancauwenberghe, Le Pecq (FR); Eric P. Donzier, Bercheres sur Vesgre (FR); Akihito Chikenji, Paris (FR); Anthony Robert Holmes Goodwin, Sugar Land, TX (US); Julian J. Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 38 days.

(21) Appl. No.: 11/231,269

(22) Filed: Sep. 19, 2005

(65) Prior Publication Data

US 2007/0062695 A1 Mar. 22, 2007

(51) Int. Cl.
*E21B 47/01* (2006.01)

(52) U.S. Cl. ..... 166/250.01; 166/66; 166/242.4

(58) Field of Classification Search ..... 166/250.11, 166/250.05, 66, 242.4, 250.01, 250.03; 73/152.18, 73/152.54, 152.55, 862.454
See application file for complete search history.

(56) References Cited

U.S. PATENT DOCUMENTS

| | | | | |
|---|---|---|---|---|
| 2,642,654 | A * | 6/1953 | Ahrens | 428/566 |
| 3,780,575 | A | 12/1973 | Urbanosky | |
| 3,859,851 | A | 1/1975 | Urbanosky | |
| 4,860,581 | A | 8/1989 | Zimmerman | |
| 4,864,724 | A * | 9/1989 | Bergstrom | 29/854 |
| 5,188,876 | A * | 2/1993 | Hensel et al. | 428/76 |
| 5,338,929 | A * | 8/1994 | Douma et al. | 250/231.1 |
| 5,767,674 | A * | 6/1998 | Griffin et al. | 324/303 |
| 6,008,646 | A * | 12/1999 | Griffin et al. | 324/303 |
| 6,404,961 | B1 * | 6/2002 | Bonja et al. | 385/109 |
| 6,782,755 | B2 * | 8/2004 | Tai et al. | 73/754 |
| 6,826,964 | B2 * | 12/2004 | Nyfors | 73/861.04 |
| 6,915,686 | B2 * | 7/2005 | Baustad | 73/152.46 |
| 7,120,087 | B2 * | 10/2006 | Lee et al. | 367/15 |
| 7,159,653 | B2 * | 1/2007 | Vold | 166/242.1 |

(Continued)

FOREIGN PATENT DOCUMENTS

EP 0695853 B1 2/2001

(Continued)

OTHER PUBLICATIONS

Matsuo, et al., "Methods of ISFET Fabrication", 1981, Sensors and Actuators, Elsevier Sequoia S.A, vol. 1, pp. 77-96.

(Continued)

*Primary Examiner*—Kenneth Thompson
(74) *Attorney, Agent, or Firm*—Matthias Abrell; Jaime Castano; Dale Gaudier

(57) ABSTRACT

Protective barriers for small devices, such as sensors, actuators, flow control devices, among others, protect the devices from erosive and/or corrosive fluids, for example, formation fluids under harsh downhole conditions. The protective barriers include protective coatings and fluid diverting structures in the fluid flow which facilitate use of the small devices in high temperature-high pressure applications with erosive and/or corrosive fluids that are often found in downhole environments.

16 Claims, 7 Drawing Sheets
(4 of 7 Drawing Sheet(s) Filed in Color)

U.S. PATENT DOCUMENTS

| | | | | |
|---|---|---|---|---|
| 2002/0194906 | A1 | 12/2002 | Goodwin | |
| 2003/0151408 | A1* | 8/2003 | Kruspe et al. | 324/303 |
| 2003/0230147 | A1* | 12/2003 | Stratton et al. | 73/727 |
| 2004/0083805 | A1 | 5/2004 | Ramakrishnan et al. | |
| 2004/0207074 | A1* | 10/2004 | MacDonald et al. | 257/708 |
| 2005/0062979 | A1* | 3/2005 | Zhu et al. | 356/480 |
| 2005/0218898 | A1* | 10/2005 | Fredette et al. | 324/342 |
| 2006/0153508 | A1* | 7/2006 | Bowker et al. | 385/100 |
| 2006/0182881 | A1* | 8/2006 | Montano et al. | 427/162 |

FOREIGN PATENT DOCUMENTS

| | | | |
|---|---|---|---|
| WO | WO 99/19653 | A1 | 4/1999 |
| WO | WO 00/46485 | A2 | 8/2000 |
| WO | WO 02/093126 | A2 | 11/2002 |
| WO | WO 02093126 | A2 * | 11/2002 |

OTHER PUBLICATIONS

Sparks, "Packing of Microsystems for Harsh Environments", IEEE Instrumentation & Measurement Magazine, Sep. 2001, pp. 30-33.

Eriksen, et al., "Protective Coatings in Harsh Environments", J. Micromec. Microeng, 1996, vol. 6, pp. 55-57.

Dyrbye, el al., "Packaging of Physical Sensors for Aggressive Media Applications", J. Micromech. Microeng, 1996, vol. 6, pp. 187-192.

Pan et al., "Corrosion Resistance for Biomaterial Applications of TiO2 Films Deposiled on Titanium and Stainless Steel by Ion-Beam-Assisted Sputtering", Journal of Biomedical Materials Research, 1997, vol. 35, pp. 309-318.

Cunha, et al., "Corrosion of TiN, (TiA1)N and CrN Hard Coatings Produced by Magnetron Sputtering", Thin Solid Films, 1998, vol. 317, pp. 351-355.

* cited by examiner

PROTECTIVE BARRIERS FOR SMALL DEVICES

TECHNICAL FIELD

The present invention relates to the field of small devices, such as sensors, actuators, flow control devices, heaters, fluid injectors, among others, having applications in harsh environmental conditions. More particularly, the present invention is directed to protective barriers suitable for small devices with applications in harsh environmental conditions, for example, by immersion in oilfield fluids, such as high pressure-high temperature downhole fluids that are erosive and/or corrosive in nature.

BACKGROUND OF THE INVENTION

Development and extraction of hydrocarbon reserves involves the collection and analysis of extensive data pertaining to fluids in the geological formations. For example, economic evaluations of hydrocarbon reserves in geological formations involve a thorough analysis of the formation fluids. Similarly, development and production considerations, such as methods of production, efficiency of recovery, and design of production systems for the hydrocarbon reserves, all depend upon accuracy in initial and continuing analyses of the nature and characteristics of reservoir hydrocarbon fluids. Formation analysis and evaluation requires constant measurements of formation fluids to acquire data with respect to fluid properties.

Determination of formation fluid characteristics, such as density, viscosity, temperature, pressure, gas-oil ratio (GOR), bubble point, among others, provides a way to analyze the nature and characteristics of a reservoir formation. Measurements of formation fluid properties yield insight into geological formations, such as permeability and flow characteristics. The data also provide a way to assess the economic value of hydrocarbon reserves.

Typically, formation fluid samples are obtained during the exploration phase of oilfield development, and the thermophysical properties of the fluids are determined at the surface. However, often it is necessary and/or desirable to determine certain reservoir fluid properties, such as density and viscosity of crude oil or brine, at the pressure and temperature of a hydrocarbon reservoir. Although the pressure and temperature of fluid samples at the surface can be adjusted to the conditions in the reservoir, it is sometimes difficult to obtain a fluid sample at the surface that closely replicates the downhole formation fluid in chemical composition.

It has been found that variations tend to occur in the extracted fluid samples due to volatility of lighter hydrocarbons, deposition of solids, contamination by drilling fluids, and so on. Moreover, it is very expensive to extract downhole fluid samples from a borehole, and to maintain and handle the extracted fluid samples at the surface under downhole pressure and temperature conditions. It is advantageous, therefore, to acquire and transmit fluid properties data downhole for the data to be analyzed at the surface, thereby significantly reducing the time and costs associated with hydrocarbon reservoir analysis and evaluation.

Answer products, such as analyses based on downhole fluid analysis, that relate to reservoir production and optimization are typically based on analyzing extremely small samples of downhole fluid, i.e., by volume relatively less than $10^{-9}$ of the hydrocarbon reserves in a typical geological formation. Moreover, the composition and characteristics of formation fluids in a reservoir are subject to change as the hydrocarbon reserves are developed and extracted. Therefore, it is advantageous to regularly monitor formation fluid properties by taking frequent downhole measurements of formation fluids throughout the exploration and production phases of an oilfield.

The oilfield fluids typically handled in the oil exploration and production industries are an extremely harsh operating environment in comparison with the customary conditions where small measuring and data collection devices, such as microchip sensors, are used. For example, typical downhole fluid conditions in producing hydrocarbon reservoirs include downhole temperatures from 50 to 175 degrees Celsius or more, downhole pressures from 100 to 2,000 bar, densities in the range 500 to 1300 kg $m^{-3}$, and viscosities from 0.1 to 1000 mPa s.

As a result of their chemical and compositional properties, oilfield fluids tend to be erosive and corrosive in nature. Due to the difficult environments in which oilfield equipment is deployed, the equipment must be capable of withstanding severe shock and corrosion due to the possibility of corrosive fluid constituents, such as $H_2S$ and $CO_2$, and solid particulates, such as sand, being present in flowing formation fluids. Reference is made to J. A. C. Humphrey, *Fundamental of Fluid Motion in Erosion by Solid Particle Impact*, Int. J. Heat and Fluid Flow, Volume 11, #3, Sep. 3, 1990, and references therein, for a discussion on erosion that is caused by solid particulates, such as sand, in fluids.

Furthermore, hydrocarbon reservoir fluids tend to be complex and may contain chemical components ranging from asphaltenes and waxes to methane. The composition of hydrocarbon fluids makes deposition of waxy materials on downhole tools a distinct possibility, which often is a cause of fouling of the tools.

SUMMARY OF THE INVENTION

In consequence of the background discussed above, and other factors that are known in the field of oilfield exploration and production, applicants recognized a need for robust small devices capable of withstanding extreme exposure to oilfield fluids in applications under downhole conditions.

Applicants further recognized that in the oil exploration and production industries small devices have potential applications in numerous areas relating to the evaluation and development of hydrocarbon fluids, if the small devices were suitably protected against adverse downhole-type conditions.

Applicants noted that at the present time there is no generally known protective coating or barrier suitable for protecting small devices in high pressure-high temperature harsh environments of oil industry applications.

Applicants discovered surface coatings and protective barriers that would produce a robust device suitable for applications in harsh environments, such as by immersion in formation fluids at or near downhole conditions.

Applicants recognized that their discovery would provide an integrated solution to various related failure modes of small devices in harsh downhole applications. In this, protective barriers of the present invention provide a solution to failure of the devices due to corrosion as well as erosion of electrical insulation, such as by downhole fluids. Applicants recognized that the present invention also offers a solution to failure of small devices due to the rapid flow of larger particulates or thread-like strands that could foul the behavior of a microelectromechanical systems (MEMS) type device. For example, such a failure mode would be advantageously addressed by placing suitable flow diversion elements, such as in one preferred embodiment of the invention small baffle-type devices, on one or both sides of the MEMS-type device to divert the potentially damaging materials away from the MEMS-type device.

The present invention includes a range of small devices, such as devices based on MEMS technology. The devices may be used for applications such as analyzing or measuring thermophysical properties of fluids, for example, oilfield reservoir fluids, or for flow and rate control of fluids under difficult, harsh conditions, such as downhole or in a pipeline. As used herein, the phrase "thermophysical properties" of fluids describes, for a phase of fixed chemical composition, fluid properties that change with changes in pressure and temperature, such as density and viscosity. For example, CRC Handbook of Chemistry and Physics, CRC Press, 81$^{st}$ Ed., 2000, pages 6-16, provides a list of thermophysical properties of fluids where the tabulated properties include density, energy, enthalpy, entropy, isochoric heat capacity, isobaric heat capacity, speed of sound, viscosity, thermal conductivity, and dielectric constant. Moreover, calculated thermophysical properties include compressibility factor, specific volume, density, enthalpy, internal energy, entropy, isochoric and isobaric specific heat, speed of sound, Joule-Thomson coefficient, adiabatic exponent, volume expansion coefficient, thermal pressure coefficient, saturated vapor pressure, heat of vaporization, dynamic and kinematic viscosity, thermal conductivity, temperature conductivity and Prandtl number.

Applicants recognized that problems associated with placing MEMS-based devices without suitable protection in contact with fluids at or near downhole conditions stemmed from corrosion and/or erosion effects on the devices by the fluids.

Applicants further discovered that robustness issues with respect to MEMS devices in harsh applications could be overcome by a surprisingly thin protective coating, which advantageously would not interfere with or impede operational effectiveness of the MEMS devices.

Applicants recognized that protection of MEMS-based devices that measure density and viscosity of hydrocarbon fluids would be particularly effective, though protective barriers of the invention would serve to protect any small device exposed to downhole fluids or other similar erosive and/or corrosive fluid-based environmental conditions.

Applicants further recognized that the present invention would protect MEMS-based devices from chemical-based corrosion that readily occurs in high pressure-high temperature (HPHT) saltwater found downhole. As used herein, the term "HPHT" refers to downhole temperatures in excess of ambient temperature, typically in the order of 100 degrees Celsius and more, downhole pressures typically from 100 to 2,000 bar, densities in the range 300 to 1300 kg $m^{-3}$, and viscosities from 0.1 to 1000 mPa s. In this, it is a feature of applicants' discovery that the protective coatings of the invention are surprisingly efficacious in the atypical conditions found in downhole fluids. It is applicants' unique understanding and realization of the conditions that exist in downhole fluids, in relation to placing MEMS-based devices in such adverse conditions, which led applicants to the protective barriers of the present invention.

Applicants also recognized that the protective barriers of the present invention would protect against erosion of unprotected MEMS devices by particulates suspended in rapidly flowing fluids, such as sand particulates in reservoir fluids.

Applicants further recognized that the protective barriers of the present invention would protect against fouling of small devices by drop-out materials from reservoir fluids.

In accordance with the invention, a downhole fluid analysis system includes a small device adapted for downhole use to measure a property of a flowing fluid in contact with the device and a protective barrier for protecting the device against the fluid, such as, against erosion and corrosion by the fluid. The protective barrier may comprise a coating on the device and, in one aspect of the invention, the coating may be selected from the group consisting of tantalum, tungsten, titanium, silicon, boron, aluminum, chromium, and their the oxides, carbides and nitrides. In one preferred embodiment of the invention, the coating may be selected from the group consisting of silicon carbide, boron nitride, boron carbide, tungsten carbide, chromium nitride, titanium nitride, silicon nitride, titanium carbide, tantalum carbide, tungsten, titanium, aluminum nitride, tantalum oxide, silicon carbide and titanium oxide.

In one embodiment of the invention, the coating comprises titanium nitride. In another embodiment of the invention, the coating comprises tantalum oxide. In yet another embodiment of the invention, the coating comprises an anti-adhesion layer as an outer layer of the coating on the device. In yet another embodiment of the invention, the protective barrier comprises two or more layers of coating on the device.

In another embodiment of the invention, the protective barrier comprises a first layer of tantalum oxide and a second layer of titanium nitride; the tantalum oxide layer protects against corrosion and the titanium nitride layer protects against erosion with the titanium nitride layer being over the tantalum oxide layer. An anti-adhesion layer may be deposited over the titanium nitride layer as an outer layer on the device. In yet another embodiment of the invention, the protective barrier comprises a baffle device for deflecting particulate laden flow away from the device. At least one coating may be provided on the device.

In another embodiment of the invention, a tool adapted to be movable through a borehole that traverses an earth formation comprises means for extracting a fluid from the earth formation into the tool and a small device arranged to be in fluid contact with the fluid in the tool to determine a fluid property. A protective barrier is associated with the small device for shielding the device against corrosion and erosion by the fluid.

In another aspect of the invention, a device having high temperature, high pressure applications comprises a portion for exposure to high temperature, high pressure subterranean fluids that are at least one of erosive and corrosive in nature, and a protective barrier associated with the downhole device for protecting the exposed portion of the device against at least one of erosion and corrosion by the fluids. In one preferred embodiment of the invention, the downhole device comprises a MEMS sensor.

In yet another aspect of the invention, a method of downhole fluid analysis comprises establishing fluid communication between a downhole device, adapted for measuring fluid properties under high temperature and high pressure conditions, and subterranean formation fluids in a borehole. The method of the invention provides at least one protective barrier associated with the downhole device for protecting the downhole device against erosion and corrosion by the formation fluids.

Additional advantages and novel features of the invention will be set forth in the description which follows or may be learned by those skilled in the art through reading the materials herein or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain principles of the present invention. The patent or application file contains at least one drawing executed in color. Copies of this patent or patent application publication with color drawings will be provided by the U.S. Patent and Trademark Office upon request and payment of the necessary fee.

FIG. 3(A) shows that the chip protected with a coating of silicon oxide is disabled due to corrosion of the metal wires. FIG. 3(B) shows that the chip protected with a protective coating of tantalum oxide is not attacked by downhole fluids.

Figure 1:
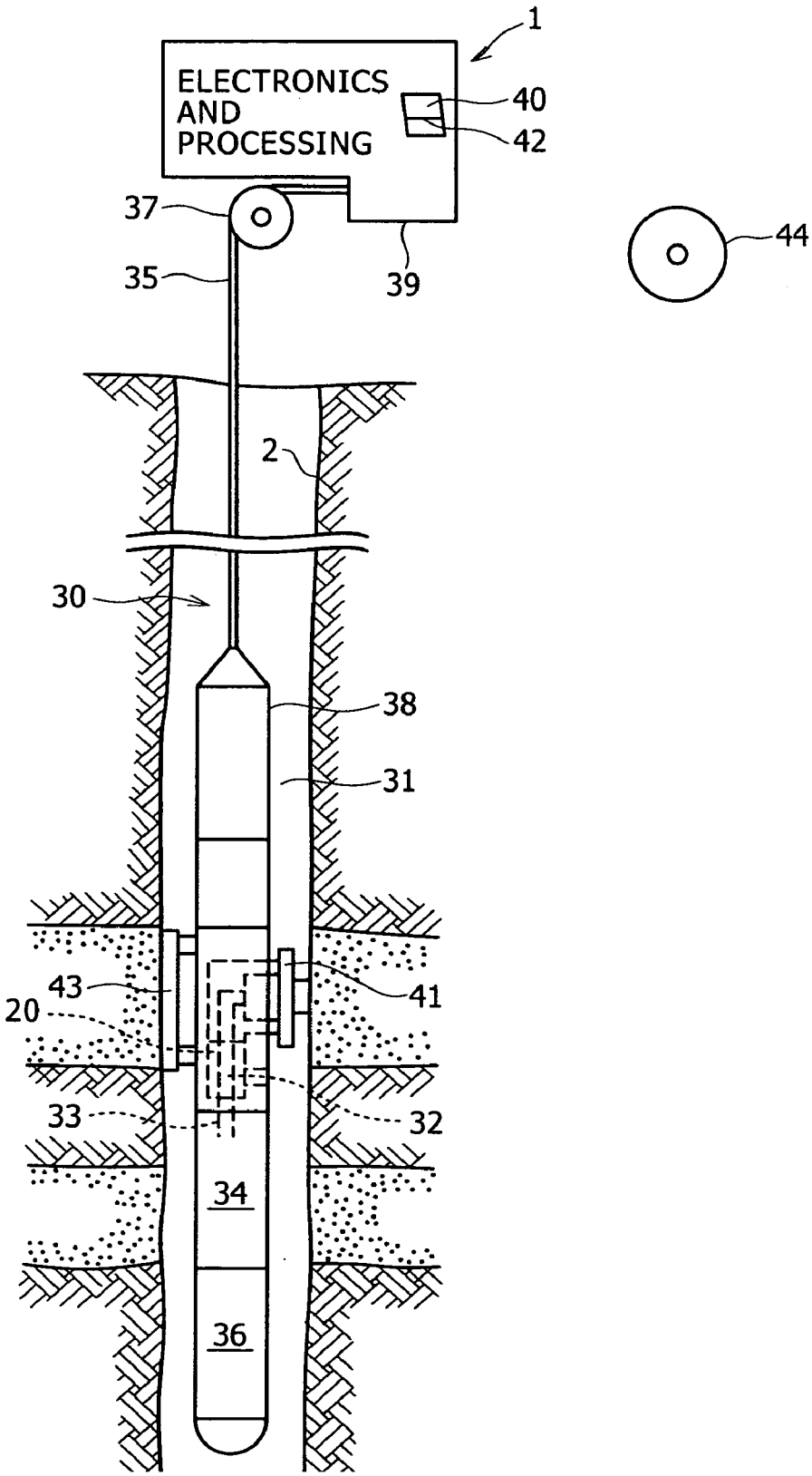
FIG. 1 is a schematic representation of one embodiment of a system for downhole analysis of formation fluids according to the present invention with an exemplary tool string deployed in a wellbore.

Throughout the drawings, identical reference numbers indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE PREFERRED EMBODIMENTS

Illustrative embodiments and aspects of the invention are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

Microfabricated and microelectromechanical (MEMS) devices are increasingly used in applications that require immersion into a variety of gases and corrosive fluids, including acids, bases, and brine. The applications range from biological, such as chemical analysis of blood samples with lab-on-a-chip implementations, to materials-based, such as combinatorial examination of various alloys in weathering tests. MEMS-based devices are also being developed to measure acceleration, resistivity, or the physical properties of fluids, as described in Schlumberger-Doll Research's (SDR) published U.S. patent application: Pub. No.: 2002/0194906, the entire contents of which are incorporated herein by reference. MEMS and other sensors for high pressure-high temperature environments are also described in U.S. patent application Pub. No. US 2007/0062274 titled Apparatus for Downhole Fluids Analysis Utilizing Micro Electrical Mechanical Systems (MEMS) or Other Sensors, with inventors Chikenji et al., filed concurrently herewith and having common ownership, the entire contents of which are incorporated herein by reference.

In many cases, a measurement is performed which necessitates application of an electric field or voltage on a MEMS sensor immersed in a fluid. In such cases, saltwater is a special challenge to electronic circuits as the resulting electric fields can induce electrochemical effects, even when coated with an insulator that inhibits corrosion. Such electrochemical effects can quickly (~1 second) destroy the sensor and lead to the production of explosive, physically damaging, or chemically corrosive gases. Furthermore, erosion of the sensor by impact of flowing suspensions of particulates can be highly damaging.

There are methods known for protecting conventional tools and instruments exposed to corrosive fluids found downhole, but the thickness of the protective coatings is typically greater than can be tolerated by a small device, such as a MEMS-based sensor. These coatings, were they to be applied to a typical MEMS device, would cause either complete failure of the sensor or, at a minimum, a highly detrimental effect to device performance. Moreover, the coatings typically contain micrometer-scale grains, the size of which is set by heat treatment and forming. This grain size is often larger than the relevant dimensions of microfabricated chips, making their use impossible or impractical at best as a protective layer for MEMS devices.

Furthermore, many of the methods of application of such coatings are incompatible with MEMS microfabrication methods due to high temperatures or electroplating baths. As a part of the invention, applicants recognized that only those materials whose grain sizes as well as fabrication and application processes are compatible with microfabrication would be acceptable as protective barriers for MEMS-type devices.

Due to a growing interest in MEMS-based sensors and measurement devices, there has been work performed on protective materials that are suitable for microfabricated sensors. It is known that humidity and moisture are "killers" of such sensors, and protective coatings for microfabricated devices have been evaluated. In their invention, applicants recognized that deficiencies such as pinholes and cracks in sputtered films would eliminate such films as a possibility for high pressure-high temperature (HPHT) oil services applications. Such cracks act as pores and allow penetration by high conductivity saltwater, destroying the device. Other known coatings are aggressively attacked by saltwater and have not performed well in tests that use the coatings as protective layers for oilfield applications. In this, applicants have found that HPHT saltwater is surprisingly effective at corroding a variety of materials that are thought of as completely compatible with water, such as glass, and that few materials can withstand this environment.

There are conventional coatings that are used to protect tools from erosion caused by wear and tear. However, usage of the conventional protective coatings has been limited to protecting macroscopic tools; it is believed that no use has been made of a hard coating to protect microfabricated products from erosion caused, for example, by the flow of suspended particles such as sand, in ultra corrosive and/or erosive environments found downhole.

In the difficult environment of HPHT oil services applications, it is highly desirable to have small devices with one or more protective harrier so that the devices can operate effectively in complicated and harsh operating environments. Applicants found no commercially available device that exists today to satisfy these requirements.

FIG. 1 is an exemplary embodiment of one system 30 for downhole analysis and sampling of formation fluids according to the present invention, for example, while a service vehicle or other surface facility 1 is situated at a wellsite. In FIG. 1, a borehole system 30 includes a borehole tool string 31, which may be used for testing earth formations and analyzing the composition of fluids from a formation. The borehole tool 31 typically is suspended in a borehole 2 from the lower end of a multiconductor logging cable or wireline 35 spooled on a winch 37 at the formation surface. The logging cable 35 typically is electrically coupled to a surface electrical control system 39 having appropriate electronics and processing systems for the borehole tool 31.

The borehole tool 31 includes an elongated body 38 encasing a variety of electronic components and modules, which are schematically represented in FIG. 1, for providing necessary and desirable functionality to the borehole tool string 31. A selectively extendible fluid admitting assembly 41 and a selectively extendible tool-anchoring member 43 are respectively arranged on opposite sides of the elongated body 38. Fluid admitting assembly 41 is operable for selectively sealing off or isolating selected portions of a borehole wall 2 such that pressure or fluid communication with adjacent earth formation is established. The fluid admitting assembly 41 may be a single probe module and/or a packer module. Examples of borehole tools are disclosed in U.S. Pat. Nos. 3,780,575, 3,859,851 and 4,860,581, the contents of which are incorporated herein by reference in their entirety.

One or more fluid analysis modules 32 may be provided in the tool body 38. Fluids obtained from a formation and/or borehole flow through a flowline 33, via the fluid analysis module or modules 32, and then may be discharged through a port of a pumpout module (not shown). Alternatively, formation fluids in the flowline 33 may be directed to one or more fluid collecting chambers 34 and 36, such as 1, 2¾, or 6 gallon (1 gallon=0.0038 $m^3$) sample chambers and/or six 450 $cm^3$ multi-sample modules, for receiving and retaining the fluids obtained from the formation for transportation to the surface.

The fluid admitting assemblies, one or more fluid analysis modules, the flow path and the collecting chambers, and other operational elements of the borehole tool string 31, are controlled by electrical control systems, such as the surface electrical control system 39. Preferably, the electrical control system 39, and other control systems situated in the tool body 38, for example, include processor capability for characterization of formation fluids in the tool 31.

The system 30 of the present invention, in its various embodiments, preferably includes a control processor 40 operatively connected with the borehole tool string 31. The control processor 40 is depicted in FIG. 1 as an element of the electrical control system 39. Preferably, processing and control methods are embodied in a computer program that runs in the processor 40 located, for example, in the control system 39. In operation, the program is coupled to receive data, for example, from the fluid analysis module 32, via the wireline cable 35, and to transmit control signals to operative elements of the borehole tool string 31.

The computer program may be stored on a computer usable storage medium 42 associated with the processor 40, or may be stored on an external computer usable storage medium 44 and electronically coupled to processor 40 for use as needed. The storage medium 44 may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein.

In preferred embodiments of the present invention, small devices 20 with protective barriers of the invention may be embodied in one or more fluid analysis modules of Schlumberger's formation tester tool, the Modular Formation Dynamics Tester (MDT). The present invention advantageously provides a formation tester tool, such as the MDT, with enhanced functionality for the downhole characterization of formation fluids and the collection of formation fluid samples. In this, the formation tester tool may advantageously be used for sampling formation fluids in conjunction with downhole characterization of the formation fluids.

Applicants have addressed the shortcomings in the prior art by suitable protective barriers that provide advantageous and surprising results when used with small devices, in particular, small measuring and data collection tools that are intended for immersion in formation fluids at or near downhole conditions. In this, it is the applicants' discovery that one or more suitable barrier may be used with a device depending on the nature and characteristics of the fluid of interest and the parameters to be measured. For example, if the fluid of interest is corrosive, but not erosive, one or more suitable protective barrier may be selected based on that prior knowledge. Similarly, if the fluid has suspended, flowing particulates, but not corrosive elements, a coating and/or baffle-type protective barrier could be selected accordingly. Such selections of suitable protective barriers are possible, without undue experimentation, by a person having skill in the art, with knowledge of the composition and nature of the fluid or fluids of interest, in light of the present invention.

Protective barriers of the present invention include, but are not limited to, coatings comprising elements such as tantalum, tungsten, titanium, silicon, boron, aluminum, chromium, among others, and their compounds such as oxides, carbides and nitrides. For example, the present invention contemplates one or more coatings of silicon carbide, boron nitride, boron carbide, tungsten carbide, chromium nitride, titanium nitride, silicon nitride, titanium carbide, tantalum carbide, tungsten, titanium, aluminum nitride, tantalum oxide, silicon carbide, titanium oxide. It is noted here that stoichiometry data for the referenced coatings have not been provided since stoichiometrical parameters of the coatings are not considered necessary features that define the coatings. Rather, suitability of any coating is determined by the utility of the coating for the protective purposes of the present invention.

Protective barriers in accordance with the present invention also may be provided by insertion of baffles in a flowline for the fluids. Moreover, small devices that are exposed to fluid borne particulates may be protected by providing streamline, steps, ramps and/or wells by modifying the flowline for the fluids in the vicinity of the small devices.

In tests performed concerning corrosion prevention with tantalum oxide, it has been found that tantalum oxide is easily applied to MEMS chips, adheres well to the sublayer, does not interfere with the chips' resonance behavior, and does not degrade upon immersion into HPHT salt water. Moreover, tantalum oxide films can easily be patterned by plasma etching, a technique known to those skilled in the art of microfabrication.

Figure 2A:
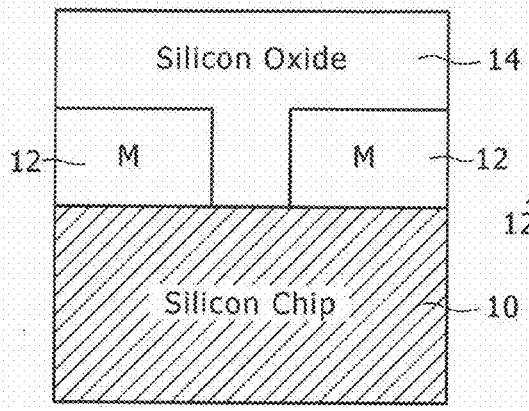
FIG. 2(A) shows a schematic representation in cross-section of silicon oxide encapsulating metal (M) lines on a silicon chip.
Figure 2B:
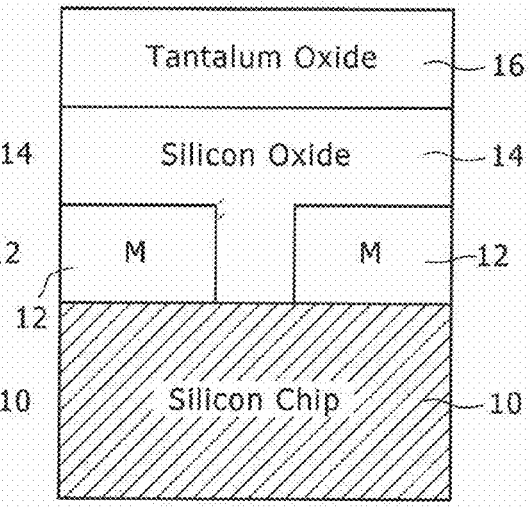
FIG. 2(B) is a schematic representation in cross-section of tantalum oxide encapsulating the silicon chip depicted in FIG. 2(A), in one embodiment of the present invention.
Figure 2C:
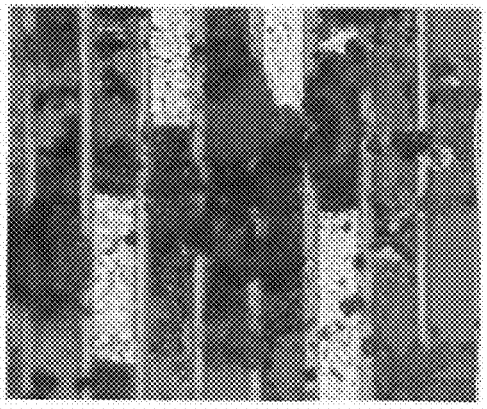
FIG. 2(C) is a plan view of a portion of a silicon chip, as schematically represented in FIG. 2(A), after immersion into saltwater, showing that silicon oxide barrier is not sufficient protection as evidenced by vertical broken wires and variation of color, the color variation being indicative of corrosion.
Figure 2D:
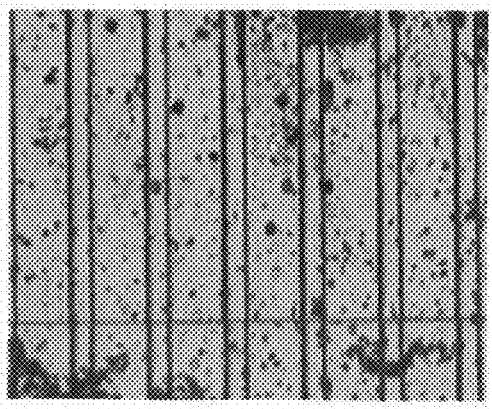
FIG. 2(D) is a plan view of a similar portion of another silicon chip, as schematically represented in FIG. 2(B), after immersion into saltwater, showing that a protective barrier of tantalum oxide protects aluminum wires from corrosion by saltwater since the wires (vertical lines) are still intact.

Laboratory experiments have demonstrated that MEMS sensors protected with a coating of tantalum oxide show a higher lifetime when exposed to corrosive fluids than MEMS sensors that are not protected with a tantalum oxide coating. FIG. 2(A) is a schematic representation in cross-section of silicon oxide encapsulating metal (M) lines on a silicon chip. FIG. 2(B) depicts an embodiment of the invention having tantalum oxide as a protective barrier encapsulating the silicon chip in FIG. 2(A). FIG. 2(C) is a plan view of a portion of a silicon chip, schematically represented in FIG. 2(A), after immersion into saltwater. FIG. 2(D) is a plan view of a portion of another silicon chip according to one embodiment of the invention with a tantalum oxide protective barrier, schematically represented in FIG. 2(B), after immersion into saltwater.

Referring to FIG. 2(A), a silicon chip 10 with aluminum wires 12 was protected with approximately 1 micrometer of silicon oxide coating 14. In FIG. 2(B), the silicon chip 10 in FIG. 2(A) is shown with the aluminum wires 12 having approximately 1 micrometer coating of amorphous tantalum oxide 16 on top of the silicon oxide coating 14 according to the present invention. After four days of being exposed to 150° C. 1.5 molar saltwater, with pressure below 10 atmospheres, the aluminum wires of the silicon oxide coated sample (FIG. 2(A)) corroded and the chip was unable to function. FIG. 2(C) is a micrograph of a portion of the silicon chip depicted in FIG. 2(A) showing corrosion and damage to the aluminum wires of the chip. In contrast, wires protected by tantalum oxide (FIG. 2(B)) exposed to the same conditions were intact and functionally unaffected by saltwater fluid, as shown in the micrograph of FIG. 2(D).

In FIG. 2(C), the wide vertical lines, broken in certain regions, correspond to the aluminum wires (M). There is a narrow gap between each of the wires that isolates each one from the others. FIG. 2(C) shows that the silicon oxide is not sufficient protection as evidenced by the broken wires and variation of color; the color variation being indicative of corrosion that has attacked or removed the aluminum wire in the darker regions.

As in FIG. 2(C), FIG. 2(D) shows vertical wires with narrow gaps in between. The small dark spots on the wires result from the grain structure of aluminum and not from corrosion. The uniform color of the wires and their unbroken structure indicate that corrosion has been inhibited by the protective coating. Hence, FIG. 2(D) shows that the tantalum oxide protects aluminum wires from corrosion. The thin horizontal line in the bottom of FIG. 2(D) is an artifact of fabrication and unrelated to the testing. It is noted that the net thickness of the coatings in FIG. 2(D) is twice that of FIG. 2(C), however, the laboratory experience of the applicants is that this comparatively small increase in film thickness does not greatly augment a coating's ability to protect a chip in the manner shown here. Rather the corrosion inhibition demonstrated by the tantalum oxide in FIG. 2(D) is ascribed to be chemical in origin.

Figure 3A:
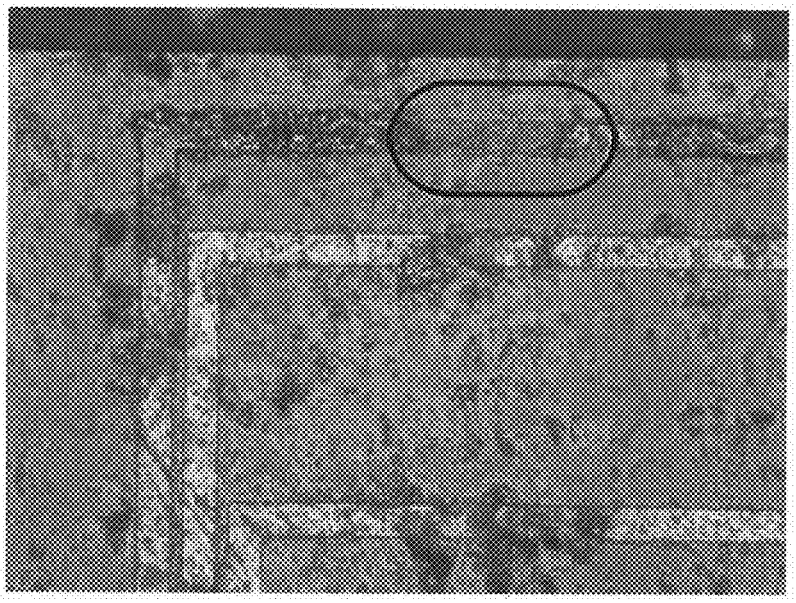
FIGS. 3(A) and 3(B) are plan views of portions of silicon chips, shown schematically in FIGS. 2(A) and 2(B), respectively, after exposure to downhole fluids during a Gulf of Mexico job using Schlumberger's Modular Formation Dynamics Tester (MDT).
Figure 3B:
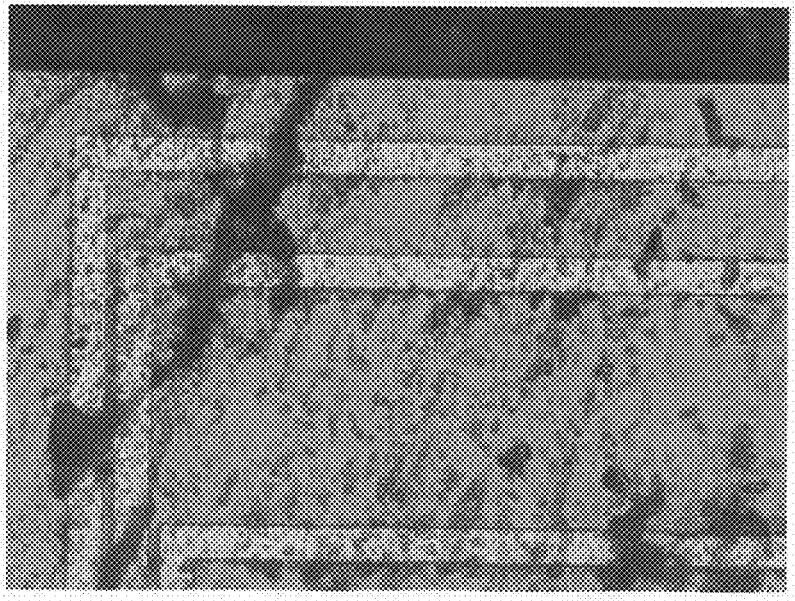

FIGS. 3(A) and 3(B) are micrographs of portions of silicon chips, shown schematically in FIGS. 2(A) and 2(B), respectively, after exposure to downhole fluids during a job in the Gulf of Mexico using Schlumberger's Modular Formation Dynamics Tester (MDT). The MDT, and hence the chips, were exposed to maximum temperature of 239 degrees Fahrenheit and pressure of 10343 psi. FIG. 3(A) shows that the chip protected with only a coating of silicon oxide (note FIG. 2(A)) is disabled due to corrosion of the metal wires. FIG. 3(B) shows that the chip protected with a coating of tantalum oxide according to the invention (note FIG. 2(B)) is not attacked after immersion into downhole fluids at a Gulf of Mexico wellsite. This qualifies as the erosive and/or corrosive HPHT environment described earlier.

The metal wires on the silicon chips appear as vertical or horizontal lines in FIGS. 3(A) and 3(B). The chip in FIG. 3(A) has been protected by a layer of silicon oxide and the metal wires have been attacked by the downhole fluids. In the circled region of FIG. 3(A), the color of the wire has changed to pink, indicative of corrosion. This indicator of corrosion is consistent with applicants' accelerated corrosion tests in the laboratory. The metal wires of the chip shown in FIG. 3(B), while covered with particulates and mud (darker matter), show no evidence of corrosion as they have been protected by a layer of tantalum oxide.

Figure 4A:
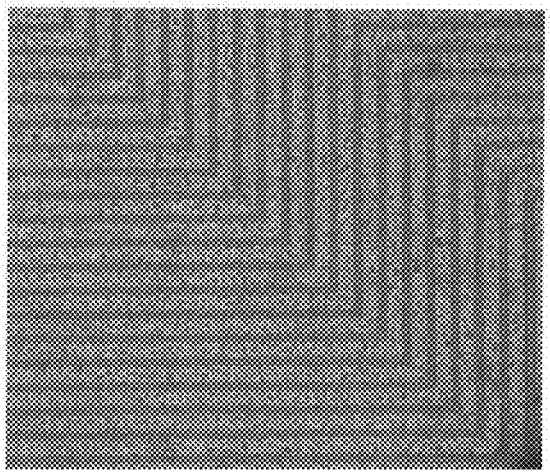
FIGS. 4(A) and 4(B) are plan views of the exact same regions of a silicon chip, shown schematically in FIG. 2(B), before and after exposure to downhole fluids during a Gulf of Mexico job using Schlumberger's Modular Formation Dynamics Tester (MDT). These two images allow for direct comparison of the metal wires before and after immersion into downhole fluids.
Figure 4B:
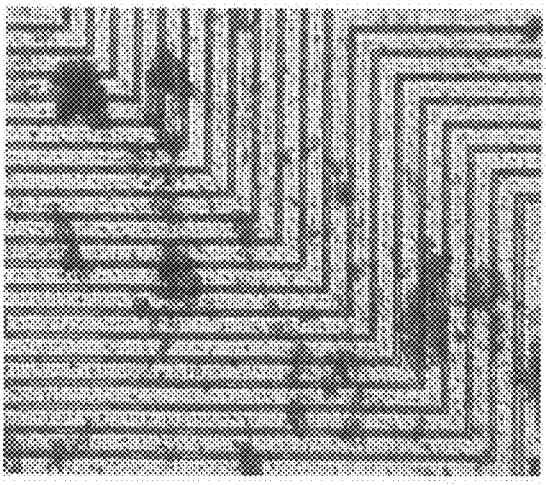

FIGS. 4(A) and 4(B) are plan views of portions of silicon chips, shown schematically in FIG. 2(B), before and after exposure to downhole fluids during a Gulf of Mexico job using Schlumberger's Modular Formation Dynamics Tester (MDT). FIG. 4(B) shows that the chip protected with a protective coating of tantalum oxide (shown in FIGS. 4(A) and 4(B)) is not attacked after immersion into downhole fluids. The chip shown in FIG. 4(B) was immersed into downhole fluids at a maximum depth of 9867 feet and maximum temperature of 195 degrees Fahrenheit for 10 hours. The water based mud had a pH of 5.4. This qualifies as the erosive and/or corrosive HPHT environment described earlier. As these two micrographs correspond to the exact same locations on the silicon chip before and after the job, they afford a direct comparison of the chip before and after exposure to the downhole fluids. The unbroken metal lines and uniform color indicate that corrosion was successfully inhibited. The dark spots that are randomly distributed are most likely mud or contamination that was not removed before the micrograph was obtained.

Figure 5A:
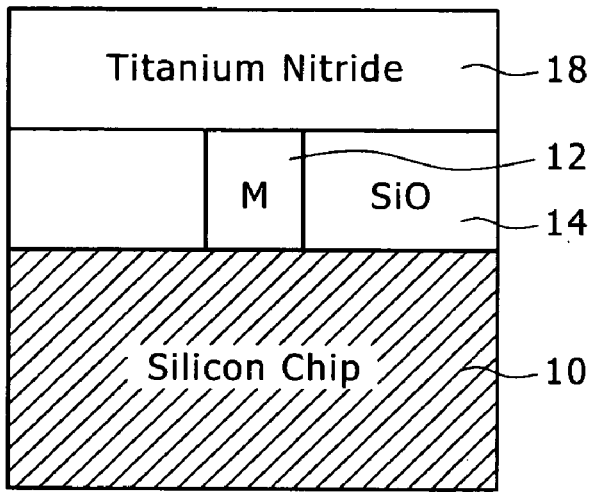
FIG. 5(A) is a schematic depiction in cross-section of a protective barrier according to another embodiment of the present invention encapsulating an exemplary silicon chip and FIG. 5(B) schematically depicts in cross-section yet another embodiment of a protective barrier according to the present invention.

FIG. 5(A) is a schematic depiction of another embodiment of the invention. In FIG. 5(A), a chip 10, as depicted in FIG.

2(A), is encapsulated with titanium nitride 18 as a protective coating according to the present invention.

Applicants discovered that for HPHT, highly corrosive and/or erosive conditions, which are found downhole at certain wellsites, a particularly advantageous protective barrier is achieved by a multi-layer, composite coating having at least two back-to-back coatings. In one preferred embodiment of the protective barrier, one layer is provided as a corrosion barrier and a second layer is provided as a hardness coating. Advantageously, the hardness coating encapsulates the corrosion barrier.

Figure 5B:
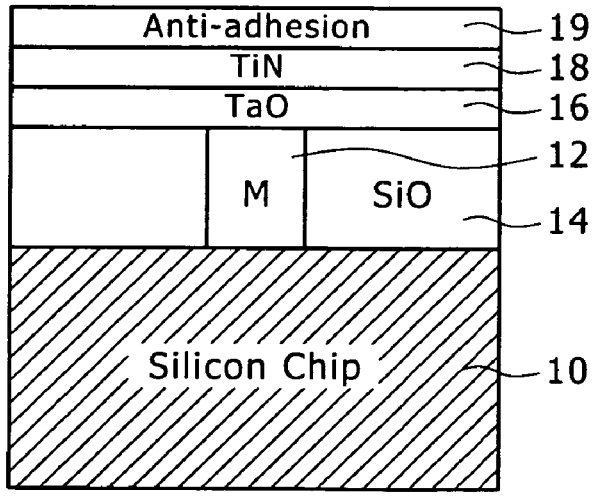

FIG. 5(B) shows schematically a composite protective barrier, according to one preferred embodiment of the present invention, encapsulating an exemplary silicon chip 10 with metal wires 12. In one preferred embodiment depicted in FIG. 5(B), tantalum oxide functions as a corrosion barrier 16 and titanium nitride as a hardness coating 18. The embodiment of FIG. 5(B) is particularly advantageous as a composite barrier for protecting small devices in the extremely harsh, particulate-laden fluid environments of the type described herein.

Advantageously, coatings of the invention are applied so that thickness of an individual coating, and combined thickness of a composite protective barrier, preferably are in the range from about 0.01 micrometer to about 100 micrometers. More preferably, thicknesses of individual coatings and combined layers are in the range from about 0.1 micrometer to about 10 micrometers. In this, it is noted that coating thickness is important from the point of suitability with respect to functionality of a device having the coating, i.e., the applied coating should not impede or prevent operation of the device. Moreover, the applied coating or combination of coatings may be varied in thickness depending on the operating conditions for the device, as previously discussed above in connection with selecting a suitable coating or combination of coatings for the device.

Applicants recognize that a single-layer coating would provide beneficial results, in particular, if the coating thickness were sufficient to provide an adequate measure of protection against fluid corrosion and/or erosion. It is also recognized that a single coating would suffice if the small device with the coating were to have an operational life for a predetermined period of time and be considered as expendable after the time-based period of use.

Applicants, however, identified desirable, unexpected results in using a multi-layer coating in particularly harsh, difficult environments found in certain wellbores. In such environmental applications, it is believed that a single-layer coating alone would suffice only to protect a microfabricated device for a limited period of time, i.e., no more than about less than 1 second to about several minutes, if immersed into a HPHT flowing, particulate-laden, corrosive fluid. For example, tantalum oxide might not have sufficient hardness to protect the device from erosion by flow of suspended particles. Rather, a multi-layer coating is preferred, advantageously with an outer layer of titanium nitride and an inner layer of tantalum oxide.

Embodiments of the present invention, such as those described above, may be made by a variety of methods.

Sputtering of tantalum oxide targets by a sputtering agent, such as a driven plasma of argon or oxygen. The sputtering agent is used to bombard a pressure ceramic target of tantalum oxide, which then sprays a beam of blasted tantalum oxide onto the substrate. Alternatively, a tantalum target can be sputtered with an oxygen plasma, thereby reacting and creating a tantalum oxide plume.

Tantalum oxide or tantalum is evaporated with an electron beam in an oxygen environment to provide a coating on the substrate.

Thin tantalum films are oxidized to produce coating of tantalum oxide on the substrate. Firstly a tantalum film is deposited, by sputtering or thermal evaporation. One implementation is to convert the metal to an oxide by immersion into an electrolytic fluid, such as acetic acid, and applying a voltage between the film and a solution. A second implementation is to convert the film to an oxide by application of an oxygen plasma, subjected to radiofrequency or other power source. A third implementation is to convert the metal film thermally, that is, by heating it up to 800 degrees Centigrade in an oxygen rich environment.

Chemical vapor deposition is a preferred method that is also used in the microchip industry. Chemical vapor deposition includes low pressure chemical vapor deposition (LPCVD) and plasma enhanced chemical vapor deposition (PECVD). In this implementation, the coating is more conformal; that is, its coating follows surface structures to form a better seal, especially those on steps. However, in order to form the gaseous organometallic precursors, corrosive or explosive gases must be handled, for which there is standard handling equipment available now. Though some carbon and hydrogen may be incorporated into the final film, perhaps changing the electrical properties, it has been found not to affect the intended use of the coating.

Titanium nitride coatings may be provided by chemical or plasma vapor deposition (CVD or PVD) and sputtering. In this, reference is made here to Cunha et al., *Thin Solid Films,* 317, (1998), at page 351 for a further description of the noted methods. PVD is a preferred method for coating titanium nitride as it provides a better conformal coating, but alternative coating methods are also contemplated in practicing the invention.

It is to be understood that while applicants have chosen the above particular parameters, such as materials, methods, other parameters and processing steps may be used to manufacture protective barriers according to the present invention. Thus, the present invention is not intended to be limited to the small devices and coating methods described herein.

Fouling of tool components, such as microfabricated sensors, optical windows, among others, exposed to downhole fluids is a concern when using the tools. Fouling can be caused by, for example, asphaltene or wax drop out. Such a thickening coating during use of a sensor alters the sensor's measurements to the point of being useless. Applicants discovered that a protective coating, deposited from a fluorine-based plasma, is compatible with MEMS-focused microfabrication processes and would prevent fouling due to its low surface-energy. Accordingly, in yet another embodiment of the invention, a fluorinated anti-adhesion layer 19 (note FIG. 5(B)) may be applied to a small device, such as a sensor, as a coating to prevent fouling of the small device by adhesion of drop-out materials from downhole fluids in contact with the device.

MEMS devices that are protected by the present invention may be used, for example, by the oil industry, to accurately and efficiently measure fluid properties, both downhole while immersed in formation fluids and at the surface in a laboratory environment, under conditions which would quickly make unprotected MEMS devices inoperative. In this, MEMS-based devices having one or more protective barriers according to the present invention may be embedded in a well or in a formation. The devices also may be incorporated into downhole sampling and fluid analysis tools, such as Schlumberger's Modular Formation Dynamics Tester (MDT), or into a sample bottle designed to hold formation fluid samples under downhole conditions.

Figure 6:
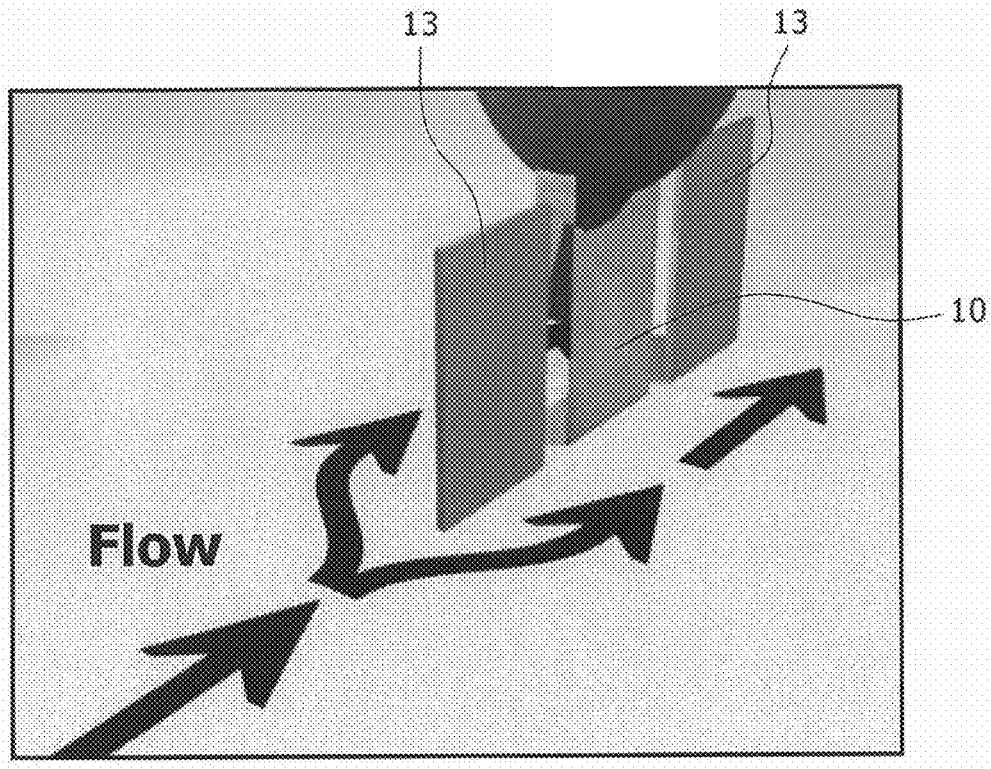
FIG. 6 is a schematic depiction of yet another embodiment of a protective barrier according to the present invention

FIG. 6 is a schematic representation of a MEMS-based sensor with protective barriers according to another embodiment of the present invention. FIG. 6 shows a small device 10, for example, a vibrating plate MEMS sensor, immersed in a fluid (arrows in FIG. 6 represent fluid flow around the device 10) flowing through a flowline of a downhole tool, such as the MDT. Since particulate laden fluid flowing over the device 10 would damage the fragile device 10, protective plates or baffles 13 may be provided in the flowline to substantially divert the particulate laden flow around the device 10, as indicated by the arrows in FIG. 6. In this, configurations of the baffles 13 may be based on the nature and configuration of the device 10 as well as operational considerations, such as fluid flow rates and nature of the particulate materials of the fluids flowing in the flowline.

The device 10 may be separated from the protective barrier or barriers 13 by a minimum value. In this, each barrier 13 is separated from the device 10 so that negligible systematic error, or one that can be compensated for, is introduced into the measurements obtained from the device 10. This value will depend upon the specific property measured. For example, in the embodiment of FIG. 6, the minimum separation value equals the largest characteristic dimension of the object, such as the width of the vibrating plate. Preferably, the thickness and length of a baffle are at least equal to the same dimensions for a device which the baffle protects. In addition to particulate materials, the flowing media might have threads or filament-like contaminants. It is intended that the baffles would protect the small devices from damage by such contaminants and these considerations also determine the dimensions of the baffles.

FIG. 6 represents schematically one preferred embodiment of the present invention. The protective barriers that are depicted in FIG. 6 may be modified so that only one baffle 13 is provided before the device 10, i.e., upstream to the device 10, so that the particulate laden fluid flows over the baffle 13 before crossing the device 10. Moreover, the baffle 13 need not be rectangular in shape as depicted in FIG. 6, but may be a wedge shaped baffle with the sharp edge toward the flowing fluid; a baffle with a profile similar to an aerofoil; a triangular baffle with the apex of the triangle toward the MEMS; and/or a semicircular baffle. Furthermore, additional barriers for protecting the small devices may include modifications to the flowline of the tool in the vicinity of the small devices, for example, by providing streamlines, steps, ramps and/or wells in the flowline to suitably divert particulate laden fluids in the flowline about the small devices.

The present invention has applicability to a range of small devices, in particular, but without limitation, a range of electro-mechanical devices. These devices tend to have a characteristic dimension less than about 500 micrometers, such as the width, thickness or length. Preferably, the devices tend to have a characteristic dimension in the range of about 10 to about 250 micrometers. In particular, the present invention contemplates protecting devices having a thickness of about 50 micrometers and less. The devices are adapted for applications in harsh and complicated fluid environments, such as analyzing and measuring thermophysical properties of oilfield fluids under downhole conditions and during transportation of erosive and/or corrosive fluids, such as for refining. In one preferred embodiment of the present invention, the coatings described herein also may be used to protect any vibrating element directly exposed to downhole fluids. In particular, vibrating element devices having sub-micrometer amplitude, which are used to measure thermophysical properties of fluids, such as viscosity and density, in the field of downhole fluid analysis may be protected by the present invention.

Typically, the electro-mechanical devices described herein are micro-machined out of a substrate material and are fabricated using technologies that have been developed to produce electronic integrated circuit (IC) devices at low cost and in large quantities, i.e., batch fabrication. Devices of this type are typically referred to as microelectromechanical systems (MEMS) devices, and applicants believe the present invention provides the first protective barriers for such small devices having applications in oilfield fluid environments, in particular, downhole fluid environments.

Figure 7:
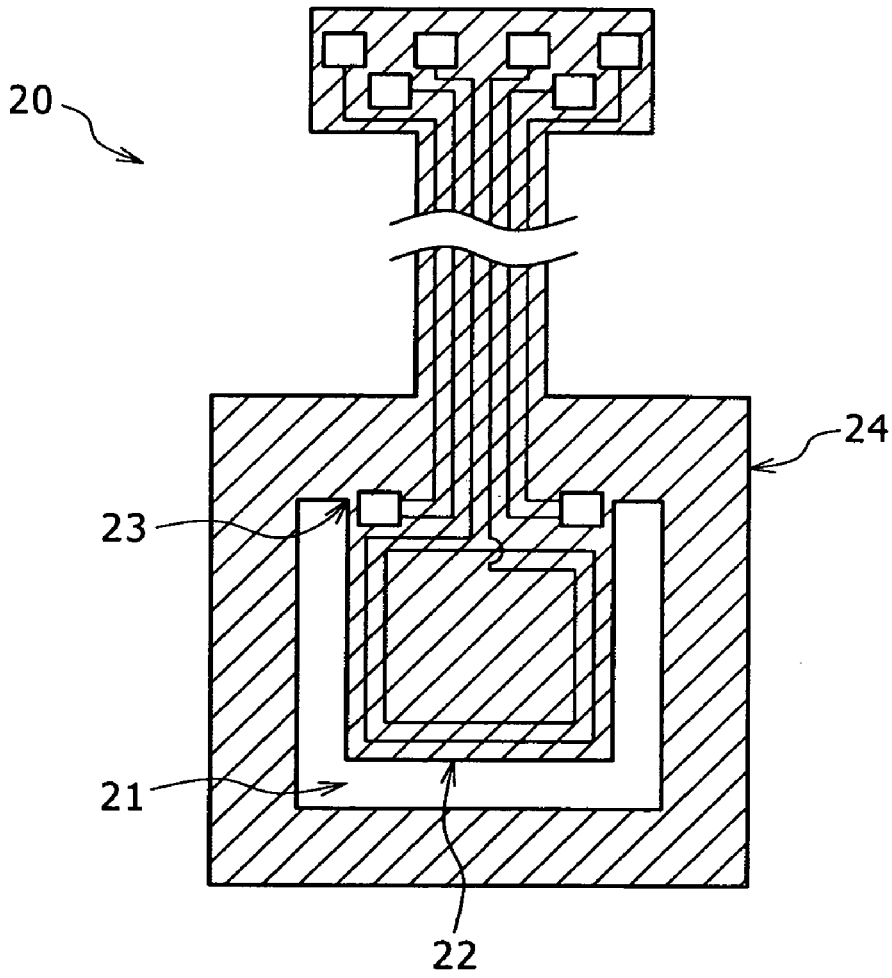
FIG. 7 illustrates one exemplary embodiment of a MEMS fluid sensor with a protective barrier according to one embodiment of the present invention.

FIG. 7 illustrate an exemplary sensor embodiment that may be protected with one or more protective barriers of the present invention. In this, only the parts of the sensor that are to be coated are shown in FIG. 7 and other parts have been omitted.

FIG. 7 is a schematic representation of a flexural plate-type MEMS-based sensor 20 having a planar member 24 with a flexural plate 22 attached thereto along one side 23. Fluid in contact with sensor 20 surrounds the flexural plate 22 and fills area 21 so that, when activated, the flexural plate 22 vibrates and causes the fluid to move. Cross-hatching in FIG. 7 represents a protective barrier for the sensor 20 to protect the sensor against adverse fluid conditions. Furthermore, as described above in connection with FIG. 6, protective barriers such as baffles and other similar devices may be provided to protect the sensor 20 from fluid damage. Though the protective barrier in FIG. 7 is shown as covering most of the sensor 20, the protective barrier may be selectively applied to cover the areas of the sensor that are at risk of being damaged by fluid contact.

In downhole tests conducted by applicants, it was found that a MEMS device protected with a protective coating of the present invention was able to withstand the high flow rates of fluids in a downhole tool. In this, applicants surprisingly found that particulate materials in the fluids did not immediately destroy the MEMS device protected in accordance with the present invention. Unexpectedly, a comparatively thin coating according to the present invention was found to be surprisingly effective in protecting a MEMS device.

Applicants found that saltwater in particular rapidly corrodes a MEMS device when operated, for example, when voltages are applied to the device in saltwater environments. In somewhat less than one minute a MEMS-based sensor is corroded by saltwater. Unexpectedly, applicants discovered that protective coatings of the present invention, having thicknesses, for example, in the range of about 1 micrometer, could extend the life of the MEMS-type device almost 10000 times longer, for example, up to 20 hours. In this, the efficacy of the coatings of the present invention in extending the life of MEMS devices was a surprising and unexpected result obtained by applicants.

Moreover, applicants found that the protective barriers of the present invention were unexpectedly effective in protecting MEMS-based devices from chemical based corrosion, which tends to occur more quickly even for coated chips at the surfaces of the chip where a wire or strain gauge is at a greater height than the rest of the chip, for example, at a step or a sidewall of the chip device. The protective coatings of the present invention were found to be surprisingly effective in spite of the almost certain existence of pin-holes in the coated MEMS-based devices tested by applicants.

The preceding description has been presented only to illustrate and describe the invention and some examples of its implementation. It is not intended to be exhaustive or to limit the invention to any precise form disclosed. Many modifications and variations are possible in light of the above teaching.

The preferred aspects were chosen and described in order to best explain principles of the invention and its practical applications. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A downhole fluids analysis system, comprising:

a small device adapted for downhole use to measure a property of a flowing fluid in contact with the device, wherein the small device is a micro-machined integrated device out of a substrate material; and a protective barrier for protecting the device against the fluid, wherein the protective barrier comprises two or more layers of coating on the device and the protective barrier comprises at least a first layer of tantalum oxide and a second layer of titanium nitride.

2. The downhole fluids analysis system claimed in claim 1, wherein the tantalum oxide layer protects against corrosion and the titanium nitride layer protects against erosion, the titanium nitride layer being over the tantalum oxide layer.

3. The downhole fluids analysis system claimed in claim 2, wherein the protective barrier further comprises: an anti-adhesion layer over the titanium nitride layer.

4. The downhole fluids analysis system claimed in claim 1, wherein the protective barrier further comprises: an anti-adhesion layer as an outer layer on the device.

5. The downhole fluids analysis system claimed in claim 1, and further comprising a baffle device for deflecting particulate laden flow away from the small device.

6. A downhole fluids analysis system, comprising:

a small device adapted for downhole use to measure a property of a flowing fluid in contact with the device, wherein the small device is a micro-machined integrated device out of a substrate material; and a protective barrier for protecting the device against the fluid wherein the protective barrier comprises a baffle device for deflecting particulate laden flow away from the device and wherein the protective barrier further comprises: a tantalum oxide layer on the device for protecting the device against corrosion and a titanium nitride layer on the device for protecting the device against erosion, the titanium nitride layer being over the tantalum oxide layer.

7. A method of downhole fluid sensing with a microelectromechanical systems device having a flexural plate comprising:

establishing fluid communication between the downhole microelectromechanical systems device, adapted for measuring fluid properties under high temperature, high pressure conditions, and subterranean formation fluids in a borehole;

providing a first protective barrier coating on the downhole microelectromechanical systems device for protecting the downhole microelectromechanical systems device against corrosion by the formation fluids by sputtering a coating of tantalum oxide on said microelectromechanical systems device;

providing a second protective barrier coating on the downhole microelectromechanical systems device for protecting the downhole microelectromechanical systems device against erosion by the formation fluids; and surrounding the flexural plate with the subterranean formation fluids so that, when activated, the flexural plate vibrates and cause the subterranean formation fluids to move.

8. A method of downhole fluid sensing with a flexural-plate microelectromechanical systems device having a planar member with a flexural plate attached thereto along one side comprising:

establishing fluid communication between the downhole microelectromechanical systems device, adapted for measuring fluid properties under high temperature, high pressure conditions, and subterranean formation fluids in a borehole;

providing a first protective barrier coating on the downhole microelectromechanical systems device for protecting the downhole microelectromechanical systems device against corrosion by the formation fluids;

providing a second protective barrier coating on the downhole microelectromechanical systems device for protecting the downhole microelectromechanical systems device against erosion by the formation fluids by depositing by plasma vapor a coating of titanium nitride on said microelectromechanical systems devices; and surrounding the flexural plate with the subterranean formation fluids so that, when activated, the flexural plate vibrates and cause the subterranean formation fluids to move.

9. A microelectromechanical systems device adapted for downhole fluids sensing comprising:

a microelectromechanical systems device adapted for downhole use to measure a property of a flowing fluid in contact with the microelectromechanical systems device, the microelectromechanical systems devise fabricated on a planar member; and at least one of a first protective coating on the microelectromechanical systems device to protect the device from downhole fluid corrosion and a second protective coating on the microelectromechanical systems device to protect the device from downhole fluid erosion, said at least one of a first and a second protective coating, having a coating thickness in the range of about 0.01 micrometers to about 100 micrometers in thickness, and said coating including at least one of an oxide, carbide and nitride of titanium.

10. A microelectromechanical systems device adapted for downhole fluids sensing as defined in claim 9 wherein said at least one of a first and second protective coating on the microelectromechanical systems device encapsulating the microelectromechanical systems device comprises:

the first protective coating is composed of at least one of an oxide, carbide and nitride of tantalum encapsulating the microelectromechanical systems device; and the second protective coating is composed of at least one of an oxide, carbide and nitride of titanium encapsulating the first protective coating and the microelectromechanical systems device.

11. A microelectromechanical systems device adapted for downhole fluids sensing as defined in claim 10 and further comprising:

a third coating of anti-adhesion material encapsulating the microelectromechanical systems device.

12. A microelectromechanical systems device adapted for downhole fluids sensing as defined in claim 10 wherein said first protective coating comprises:

a coating of tantalum oxide.

13. A microelectromechanical systems device adapted for downhole fluids sensing as defined in claim 10 wherein at least one of said first and second protective coatings are applied by:

a process of sputtering.

14. A microelectromechanical systems device adapted for downhole fluids sensing as defined in claim 10 wherein at least one of said first and second protective coatings are applied by:

a process of plasma vapor deposition.

15. A microelectromechanical systems device adapted for downhole fluids sensing as defined in claim 9 wherein:

said at least one of said first and second protective coatings is applied to be approximately one micrometer in thickness.

16. A microelectromechanical systems device adapted for downhole fluids sensing as defined in claim 9 wherein:

the coating thickness of the at least one of a first and second coatings preferably is in the range of about 0.1 micrometers to about 10 micrometers in thickness.

* * * * *